US009960535B2

(12) United States Patent
Kida

(10) Patent No.: US 9,960,535 B2
(45) Date of Patent: May 1, 2018

(54) WEATHER-PROOF CONNECTOR

(71) Applicant: YAZAKI CORPORATION, Tokyo (JP)

(72) Inventor: Kousuke Kida, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days. days.

(21) Appl. No.: 15/246,025

(22) Filed: Aug. 24, 2016

(65) Prior Publication Data

US 2017/0062969 A1 Mar. 2, 2017

(30) Foreign Application Priority Data

Aug. 24, 2015 (JP) ..... 2015-165131

(51) Int. Cl.

| | |
|---|---|
| ***H01R 13/627*** | (2006.01) |
| ***H01R 13/52*** | (2006.01) |
| *H01R 103/00* | (2006.01) |
| *H01R 13/502* | (2006.01) |
| *H01R 13/506* | (2006.01) |
| *H01R 13/56* | (2006.01) |

(52) U.S. Cl.

CPC ..... *H01R 13/6275* (2013.01); *H01R 13/5219* (2013.01); *H01R 13/506* (2013.01); *H01R 13/5025* (2013.01); *H01R 13/56* (2013.01); *H01R 2103/00* (2013.01); *H01R 2201/26* (2013.01)

(58) Field of Classification Search

CPC ..... H01R 13/4362; H01R 13/4226; H01R 13/4223

USPC ..... 439/595

See application file for complete search history.

(56) References Cited

U.S. PATENT DOCUMENTS

| | | | | |
|---|---|---|---|---|
| 6,126,478 A * | 10/2000 | Presson | H01R 13/595 439/467 |
| 6,169,159 B1 | 1/2001 | Kawamoto et al. | |
| 6,179,639 B1 | 1/2001 | Kuwahara et al. | |
| 6,196,860 B1 | 3/2001 | Okayasu et al. | |
| 6,358,102 B1 * | 3/2002 | Fukamachi | H01R 13/4362 439/752 |
| 6,454,594 B2 * | 9/2002 | Sawayanagi | H01R 12/68 439/467 |

(Continued)

FOREIGN PATENT DOCUMENTS

| | | |
|---|---|---|
| JP | 11-43532 A | 2/1999 |
| JP | 11-162568 A | 6/1999 |

(Continued)

OTHER PUBLICATIONS

Japanese Office Action for the related Japanese Patent Application No. 2015-165131 dated Sep. 5, 2017.

(Continued)

*Primary Examiner* — Tulsidas C Patel
*Assistant Examiner* — Marcus Harcum
(74) *Attorney, Agent, or Firm* — Kenealy Vaidya LLP

(57) ABSTRACT

A connector includes a first member constituting a main body of the connector; and one or a plurality of second members attached to the first member. A specific member is selected from the group consisting of the first member and the second members to have a portion to be elastically deformed upon the attachment, and the specific member is formed of a hydrolysis-resistant material.

9 Claims, 8 Drawing Sheets

(56) References Cited

U.S. PATENT DOCUMENTS

| | | | | |
|---|---|---|---|---|
| 6,475,008 | B1 * | 11/2002 | Marolda | H01R 13/523 439/271 |
| 6,478,609 | B1 * | 11/2002 | Davis | H01R 13/5812 439/465 |
| 6,902,423 | B2 * | 6/2005 | Castaldo | H01R 13/5829 439/467 |
| 6,955,558 | B1 * | 10/2005 | Low | H02G 15/013 439/467 |
| 7,465,185 | B2 * | 12/2008 | Tyler | H01R 13/506 439/352 |
| 7,500,887 | B2 * | 3/2009 | Ichio | H01R 13/4362 439/595 |
| 8,366,472 | B2 * | 2/2013 | Miyamoto | H01R 13/4361 439/345 |
| 8,678,864 | B2 * | 3/2014 | Yoshikawa | H02S 40/34 439/620.21 |
| 8,758,038 | B2 | 6/2014 | Kubo et al. | |
| 8,882,528 | B2 | 11/2014 | Sasho et al. | |
| 9,118,127 | B2 * | 8/2015 | Matsunaga | H01R 13/10 |
| 2001/0035652 | A1 | 11/2001 | Wada et al. | |
| 2003/0022549 | A1 * | 1/2003 | Castaldo | H01R 24/28 439/467 |
| 2005/0176298 | A1 * | 8/2005 | Flowers | H01R 13/4365 439/595 |
| 2005/0186842 | A1 * | 8/2005 | Fukatsu | H01R 13/4223 439/595 |
| 2013/0084733 | A1 | 4/2013 | Kubo et al. | |
| 2014/0131064 | A1 * | 5/2014 | Yamada | H01B 13/14 174/117 F |
| 2014/0364005 | A1 * | 12/2014 | Yagi | H01R 43/22 439/595 |

FOREIGN PATENT DOCUMENTS

| | | | |
|---|---|---|---|
| JP | 2001-250636 | A | 9/2001 |
| JP | 2007-291277 | A | 11/2007 |
| JP | 2009-76234 | A | 4/2009 |
| JP | 2013-77440 | A | 4/2013 |
| JP | 2014-167042 | A | 9/2014 |

OTHER PUBLICATIONS

Japanese Office Action for the related Japanese Patent Application No. 2015-165131 dated Mar. 6, 2018.

* cited by examiner

WEATHER-PROOF CONNECTOR

CROSS-REFERENCES TO RELATED APPLICATION(S)

This application is based on and claims priority from Japanese Patent Application No. 2015-165131 filed on Aug. 24, 2015, and the entire contents of which are incorporated herein by reference.

BACKGROUND

Field of the Invention

The invention relates to a connector including a connector main body and a plurality of other members attached to the connector main body.

Description of Related Art

Connectors typically have portions which are bent (i.e., elastically deformed) when being used. For example, one of such connectors (hereinafter, referred to as a "conventional connector") is configured to be connected to or released from a mating connector when being used, and includes a cantilevered lock arm which can be locked to the mating connector. The lock arm is configured to bend (i.e., elastically deform) around its fixed end (base portion) when the conventional connector is connected to the mating connector.

As for details of the conventional example, refer to JP 2001-250636 A.

SUMMARY

Connectors may have portions to be elastically deformed (bent) when being used in addition to the lock arm. For example, in a case where a connector is formed by combining a connector main body (e.g., a connector housing) and a plurality of other members (e.g., a cover to guide an electric wire), the portions to be elastically deformed when being used (mounted or removed) include a locking portion for fixing the other member to the connector main body, and a locking portion for assembling a plurality of parts if the other member is an aggregate of a plurality of the parts.

Meanwhile, connectors are typically made of thermoplastic polyester resins such as polybutylene terephthalate (PBT) and are formed by injection molding. However, hydrolysis of polymer chains of the polyester resins easily occurs when the polyester resins are in contact with water under a high temperature. The hydrolysis may reduce mechanical strengths of connectors (in other word, connectors may deteriorate) when the connector is used under a high-temperature and high-humidity environment such as a vehicle engine compartment over a long period.

Connectors are typically designed in consideration of the mechanical strengths reduction, and thus such deterioration of connectors does not normally result in substantial problems. However, in such conditions where a connector is used over a long period exceeding predetermined design conditions and when the mechanical strengths of the connector reduced too much, the conditions may damage the connector particularly at the portions to be elastically deformed (bent). It is preferable to reduce the damage as much as possible.

It is an object of the present invention, in view of the above problems, to provide a connector capable of reducing the damage at the portions to be elastically deformed as much as possible even in such conditions where the connector is used over a long period under a high-temperature and high-humidity environment.

Connectors according to the invention include the following items (1) to (5).

(1) A connector comprising:

a first member constituting a main body of the connector; and one or a plurality of second members attached to the first member, a specific member being selected from the group consisting of the first member and the second members to have a portion to be elastically deformed upon the attachment, the specific member being formed of a hydrolysis-resistant material.

(2) The connector according to the item (1), wherein the specific member has a cantilevered engagement portion as the portion to be elastically deformed upon the attachment.

(3) The connector according to the item (1), wherein the specific member is the second member constituting a cover to guide an electric wire extending from the first member constituting the main body of the connector, the specific member is attached to the first member.

(4) The connector according to the item (3), wherein the specific member is the second member constituting a spacer attached inside of the first member constituting the main body of the connector, and the spacer has a lance, as the portion to be elastically deformed upon the attachment, to engage with an electric terminal housed inside the main body.

(5) The connector according to the item (1), wherein the first member has a lock arm to be elastically deformed when being connected to a mating connector, and the first member is formed of the hydrolysis-resistant material.

According to the configuration of the above item (1), the specific member, which is a member among various members to form the connector, has a portion to be elastically deformed when the various members (the first member and the second member) are attached each other. The specific member is formed of a hydrolysis-resistant material. Accordingly, it is possible to reduce the deterioration of the specific member, which is a member to be particularly damaged due to the hydrolysis of a constituent material. As a result, the connector of this configuration is capable of reducing the damage at the portions to be elastically deformed as much as possible even in such conditions where the connector is used over a long period under a high-temperature and high-humidity environment, compared to a case where the specific member is not formed of a hydrolysis-resistant material.

Meanwhile, the hydrolysis-resistant material used for the connector is not particularly limited as long as it is a material having superior hydrolysis-resistant. For example, a composite material of polybutylene terephthalate (PBT) and glass fibers may be used as the hydrolysis-resistant material. However, PBT is one of polyester resins and thus can cause hydrolysis of its polymer chains depending on its usage environment due to hydroxyl groups and ester bonds in its molecular frame and water in the environment. Hence, the composite material may preferably include specific PBT that has been subjected to a treatment to enhance its hydrolysis-resistant performance. For example, such specific PBT includes the PBT-GF15. In addition, the treatment to enhance its hydrolysis-resistant performance includes a treatment to replace the hydroxyl group (—OH) of the carboxyl group (—COOH), which affects the hydrolysis of PBT, with other atom or other molecule serving to enhance hydrolysis-resistant performance (for example, see JP H08-208816 A).

According to the configuration of the above item (2), it is possible to reduce the deterioration of the specific member that has the cantilevered engagement portion, which is a portion to be particularly damaged due to the reduction of mechanical strengths. In other words, the connector of this configuration is formed under a technical concept to reduce the deterioration of the specific member having the cantilevered engagement portion in preference to the deterioration of other specific members.

In addition, the portion that is elastically deformed in the process of the attachment is not necessarily limited to the cantilevered engagement portion. For example, in a case where a projection portion of one member is press-fitted to a recessed portion of another member, the projection portion and the recessed portion correspond to the portion that is elastically deformed.

According to the configuration of the above item (3), it is possible to reduce the deterioration of the main body and the cover, which are exposed to the outside air when the connector is used. In other words, the connector of this configuration is formed under a technical concept to reduce the deterioration of the specific member exposed to the outside air in preference to the deterioration of other specific members.

According to the configuration of the above item (4), it is possible to reduce the deterioration of the spacer which is hardly exposed to the outside air when the connector is used, in addition to the main body and the cover which are exposed to the outside air when the connector is used. As a result, it is possible to increase reliability of the entire connector.

According to the configuration of the above item (5), it is possible to reduce the deterioration of the lock arm, which is elastically deformed repeatedly when being connected to or released from the mating connector.

According to the invention, it is possible to reduce the damage to the connector at the portions to be elastically deformed as much as possible even in such conditions where the connector is used over a long period under a high-temperature and high-humidity environment.

The invention is briefly described above. Furthermore, some embodiments of the invention will be described below with some drawings to give clear details of the invention.

DETAILED DESCRIPTION

Hereinafter, a connector (hereinafter referred to as a "connector 100") according to an embodiment of the invention will be described with reference to the drawings.

Assembly of Connector Housing and Electric Wire Guide Cover

Figure 1:
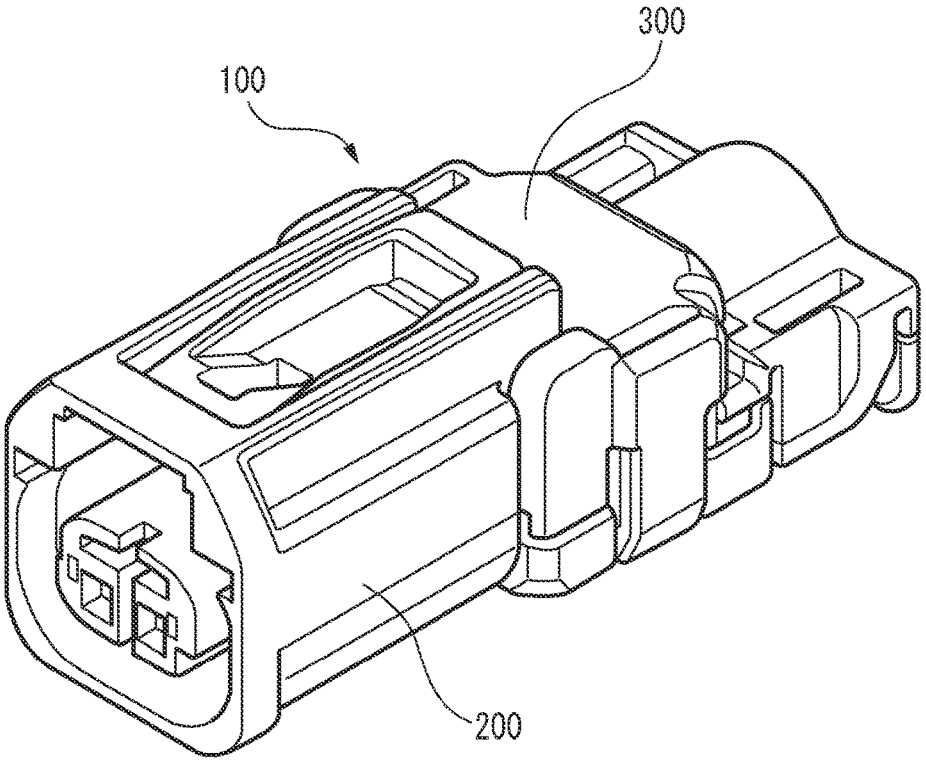
FIG. 1 is a schematic perspective view showing a configuration of a connector according to an embodiment of the invention.

As shown in FIG. 1, the connector 100 includes a connector housing 200, and an electric wire guide cover 300 which is attached to the end portion of the connector housing 200.

Figure 2:
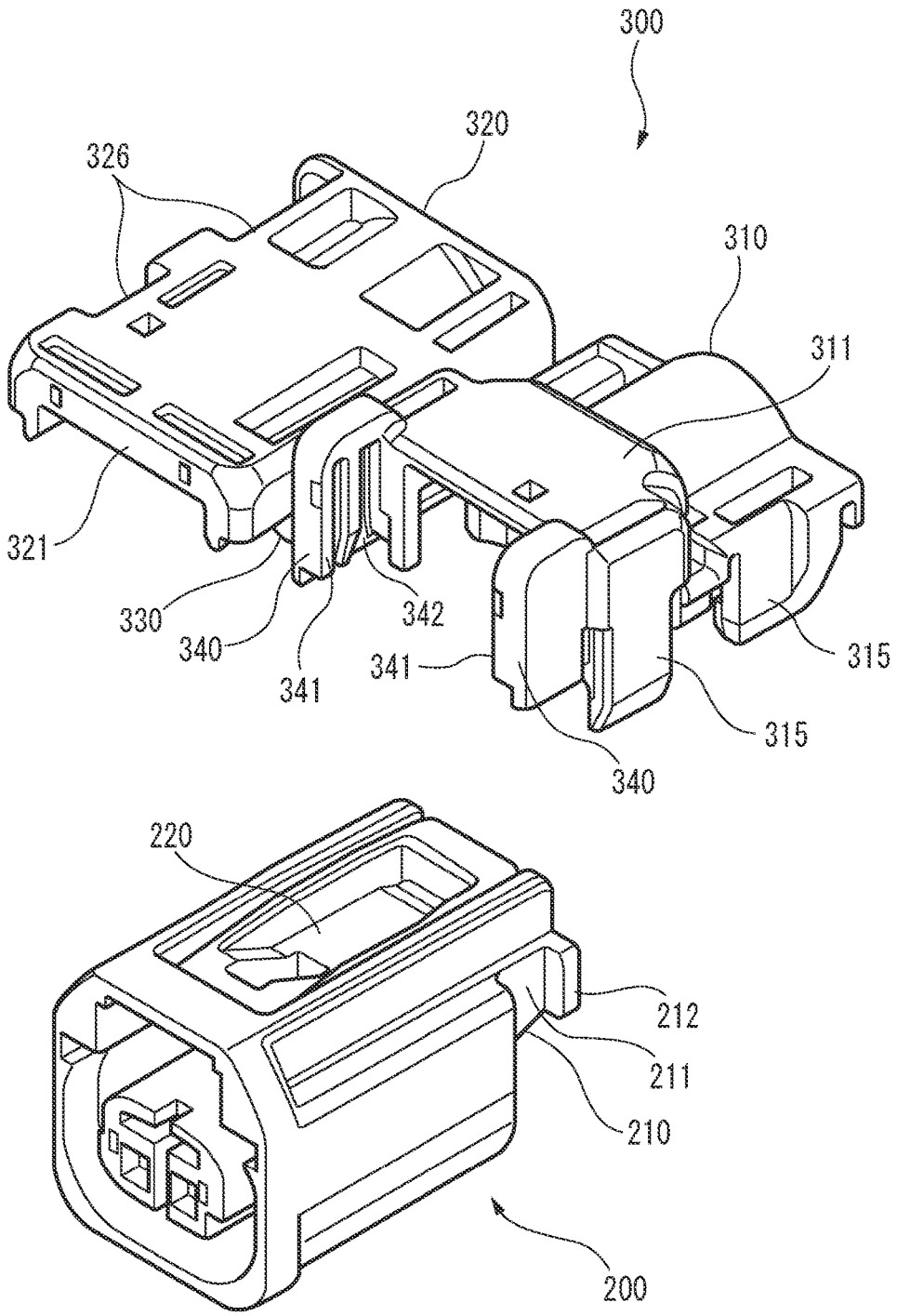
FIG. 2 is a schematic perspective view showing a state where a main body and an electric wire guide cover of the connector shown in FIG. 1 are separated from each other.

More specifically, as shown in FIG. 2, the connector housing 200 includes a cover mounting portion 210 for mounting the electric wire guide cover 300 on an end portion (hereinafter, for convenience, referred to as a "rear end portion") to which the electric wire guide cover 300 is attached. The cover mounting portion 210 is configured of a recessed portion 211 and a projection portion 212 which vertically extend in FIG. 2. The connector housing 200 includes a lock arm 220 which is elastically deformed when the connector housing 200 is attached to (attached to or detached from) a mating connector 900. The lock arm 220 will be described in detail below.

Figure 3:
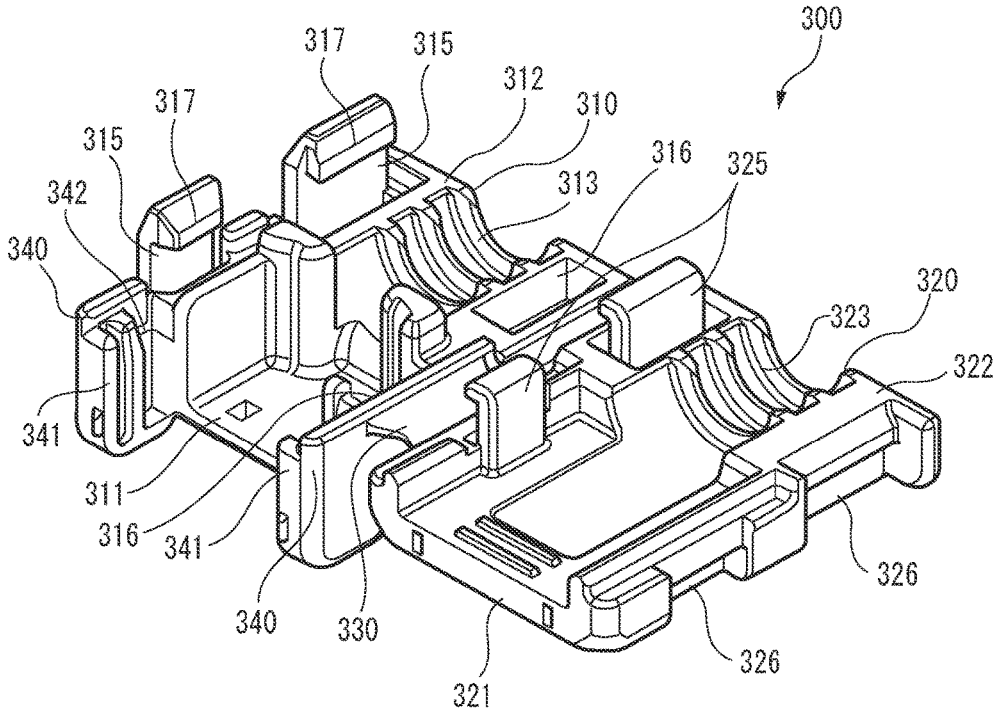
FIG. 3 is a schematic perspective view showing an internal structure of the electric wire guide cover shown in FIG. 2.

The electric wire guide cover 300 is attached to the cover mounting portion 210 of the connector housing 200 so as to guide an electric wire (not shown) which extends rearward from the connector housing 200. More specifically, as shown in FIGS. 2 and 3, the electric wire guide cover 300 includes an upper cover 310, a lower cover 320, and a thin hinge 330 which connects the upper cover 310 and the lower cover 320 so as to be freely opened and closed. The thin hinge 330 is disposed so as to connect the edge portion of the upper cover 310 and the edge portion of the lower cover 320.

The upper cover 310 and the lower cover 320 can rotate about the thin hinge 330 such that mating surfaces 312 and 322 formed on respective main plate portions 311 and 321 come into close contact with each other. If the mating surfaces 312 and 322 come into close contact with each other, as shown in FIG. 1, the electric wire guide cover 300 is closed. In this closed state of the electric wire guide cover 300, a corrugate tube (and an electric wire inside the corrugate tube) (not shown) is interposed between electric wire holding grooves 313 and 323 of the upper cover 310 and the lower cover 320.

A pair of right and left connection walls 340 for engaging with the cover mounting portions 210 formed on the rear end portions of the connector housing 200 is provided on the end portions (hereinafter, for convenience, referred to as "front end portions") of the upper cover 310 attached to the connector housing 200. Engagement projection portions 341 which engage with the recessed portions 211 of the cover mounting portion 210 while sliding from the upper portion to the lower portion, and engagement recessed portions 342 which engage with the projection portions 212 of the cover mounting portion 210 while sliding from the upper portion to the lower portion are provided on the inner surfaces of the pair of connection walls 340 facing each other.

Each of the engagement recessed portions 342 has a shape in which the lower end thereof is closed (a shape in which a wall surface is formed on the lower end). Accordingly, when the upper cover 310 slides in a state where the engagement projection portions 341 and the engagement recessed portions 342 correspond to the recessed portions 211 and the projection portions 212 of the cover mounting portion 210, the upper cover 310 stops at an appropriate position.

If the lower cover 320 is closed toward the lower surface of the upper cover 310 in a state where the pair of right and left connection walls 340 of the upper cover 310 engages with the cover mounting portion 210, the electric wire guide cover 300 is closed. In this way, when the electric wire guide cover 300 is closed, the cover mounting portion 210 is interposed between the upper cover 310 and the lower cover 320, the connector housing 200 and the electric wire guide cover 300 engage with each other (are fixed to each other) so as not to be moved relative to each other.

The upper cover 310 includes engagement pieces 315, which protrude in a direction (upward in FIG. 3) moving away from the main plate portion 311, on the edge portion opposite to the edge portion of the main plate portion 311 on which the thin hinge 330 is provided. Meanwhile, the lower cover 320 includes engagement pieces 325, which protrude in a direction (upward in FIG. 3) moving away from the main plate portion 321, on the edge portion opposite to the edge portion of the main plate portion 321 on which the thin hinge 330 is provided. Each of the engagement pieces 315 and 325 has a cantilevered shape.

When the electric wire guide cover 300 is closed, the engagement pieces 315 of the upper cover 310 engage with the engagement recessed portions 326 provided on the lower cover 320, and the closed state of the electric wire guide cover 300 is maintained. Similarly, when the electric wire guide cover 300 is closed, the engagement pieces 325 of the lower cover 320 engage with the engagement recessed portions 316 provided on the upper cover 310, and the closed state of the electric wire guide cover 300 is maintained.

Each of the engagement pieces 315 has a lock claw 317 on the tip thereof. The lock claws 317 come into contact with the surface of the lower cover 320 in the vicinities of the engagement recessed portions 326 in a process in which the engagement pieces 315 engage with the engagement recessed portions 326, and is pressed in the direction moving away from the surface of the lower cover 320. As a result, the engagement pieces 315 are bent (elastically deformed) in the direction moving away from the surface of the lower cover 320. If the lock claws 317 reach the engagement recessed portions 326, the lock claws 317 engage with the engagement recessed portions 326, and the shapes of the engagement pieces 315 are returned to the shapes (original shapes) before the engagement pieces 315 are elastically deformed. Similarly, after the engagement pieces 325 are temporarily elastic-deformed in a process in which the engagement pieces 325 engage with the engagement recessed portions 316, the engagement pieces 325 are returned to the original shapes.

In this way, the engagement pieces 315 and 325 are the portions which are elastically deformed in the process in which the electric wire guide cover 300 is attached to the connector housing 200.

Figure 4:
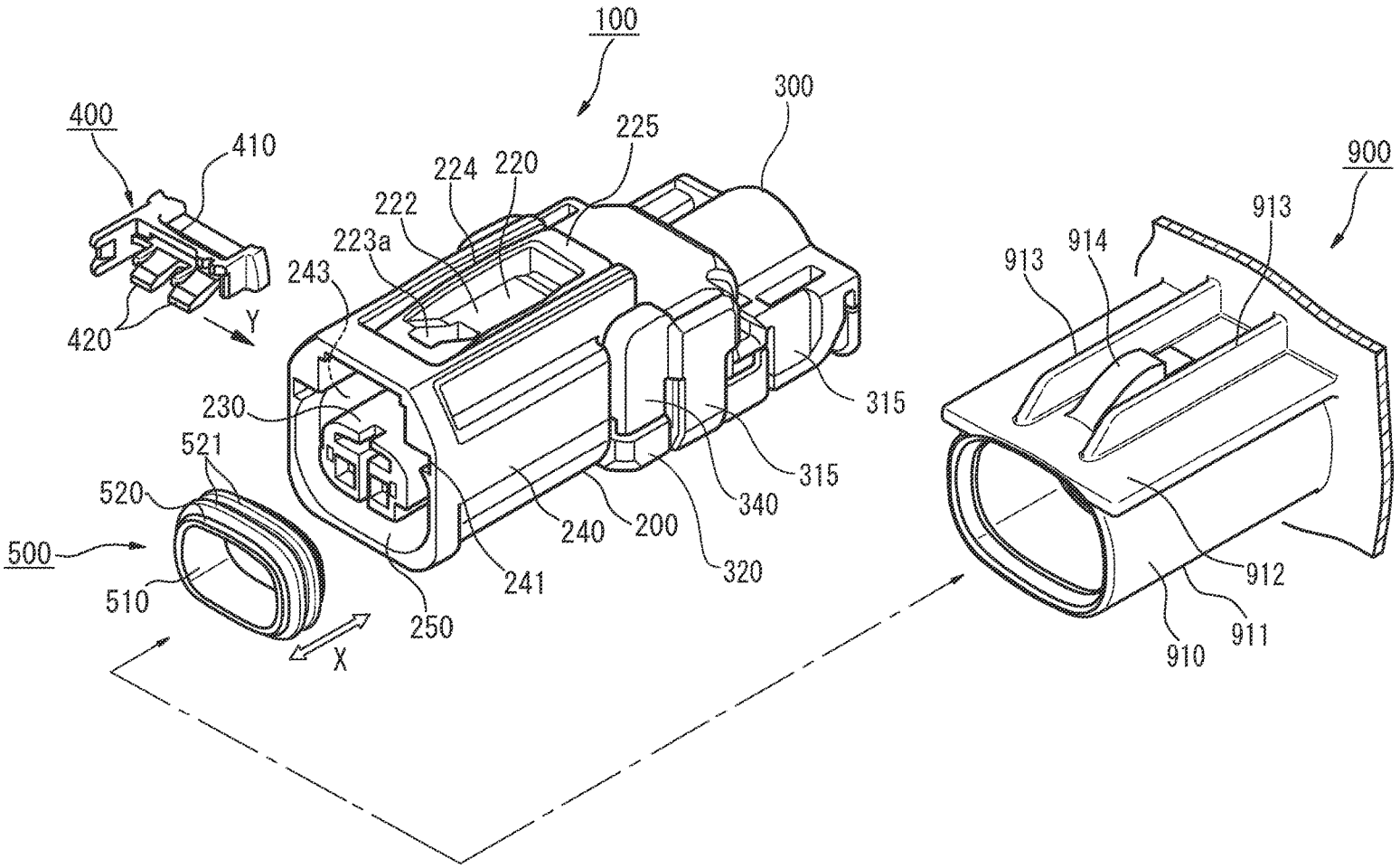
FIG. 4 is an exploded perspective view explaining an aspect where the connector (the electric wire guide cover is not shown) shown in FIG. 1 is assembled to a mating connector.
Figure 5:
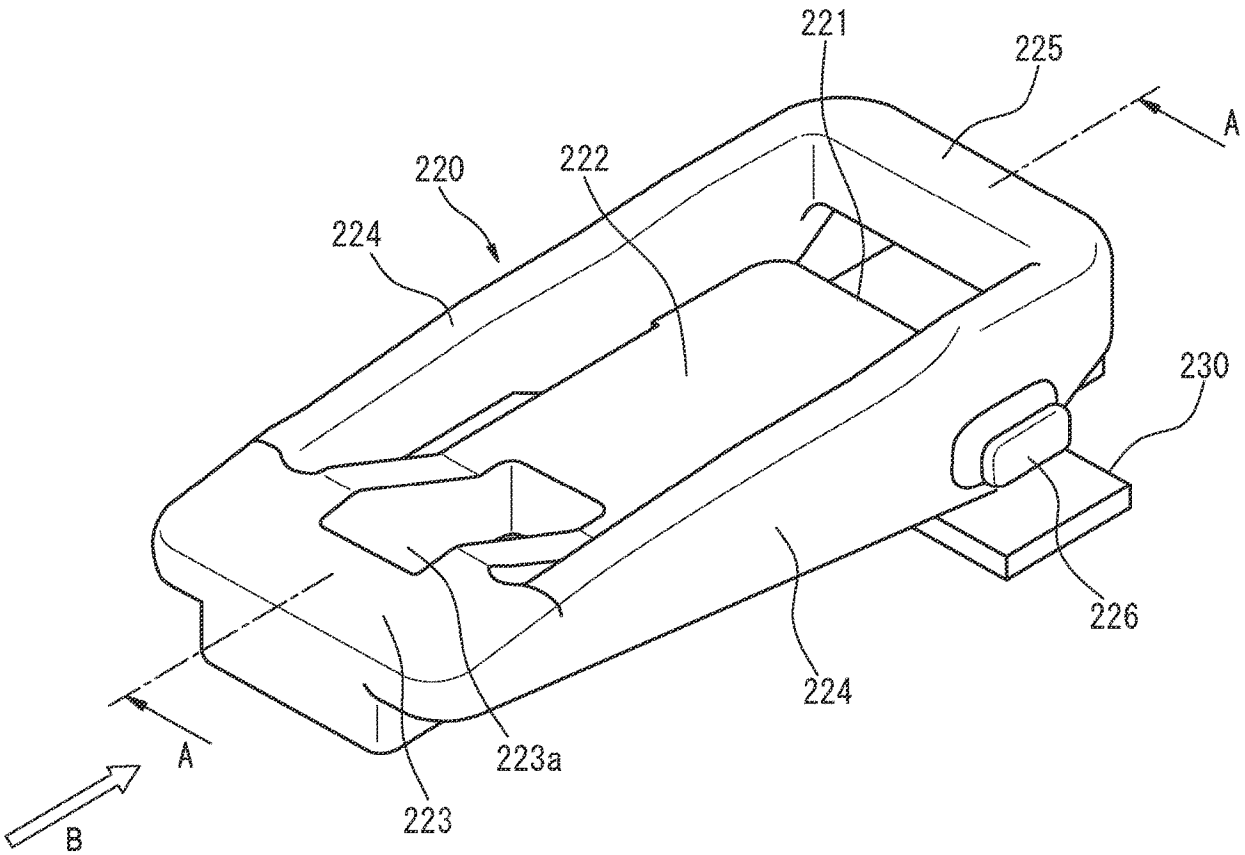
FIG. 5 is an enlarged perspective view showing a lock arm which is included in a connector housing of the connector shown in FIG. 1.

Next, an aspect in which the mating connector 900 is attached to the above-described connector 100 will be described. As shown in FIG. 4, the connector housing 200 of the connector 100 includes the above-described lock arm 220, a terminal housing portion 230 in which a first electric wire terminal (not shown) is housed, and a hood portion 240 which surrounds the vicinity of the terminal housing portion 230 and has a tubular shape. In FIG. 4, for convenience of description, an electric wire extending from the connector 100 is not shown.

The terminal housing portion 230 has an approximately columnar shape extending in a fitting direction (an arrow X direction in FIG. 4) between the mating connector 900 and the connector housing 910.

Figure 6:
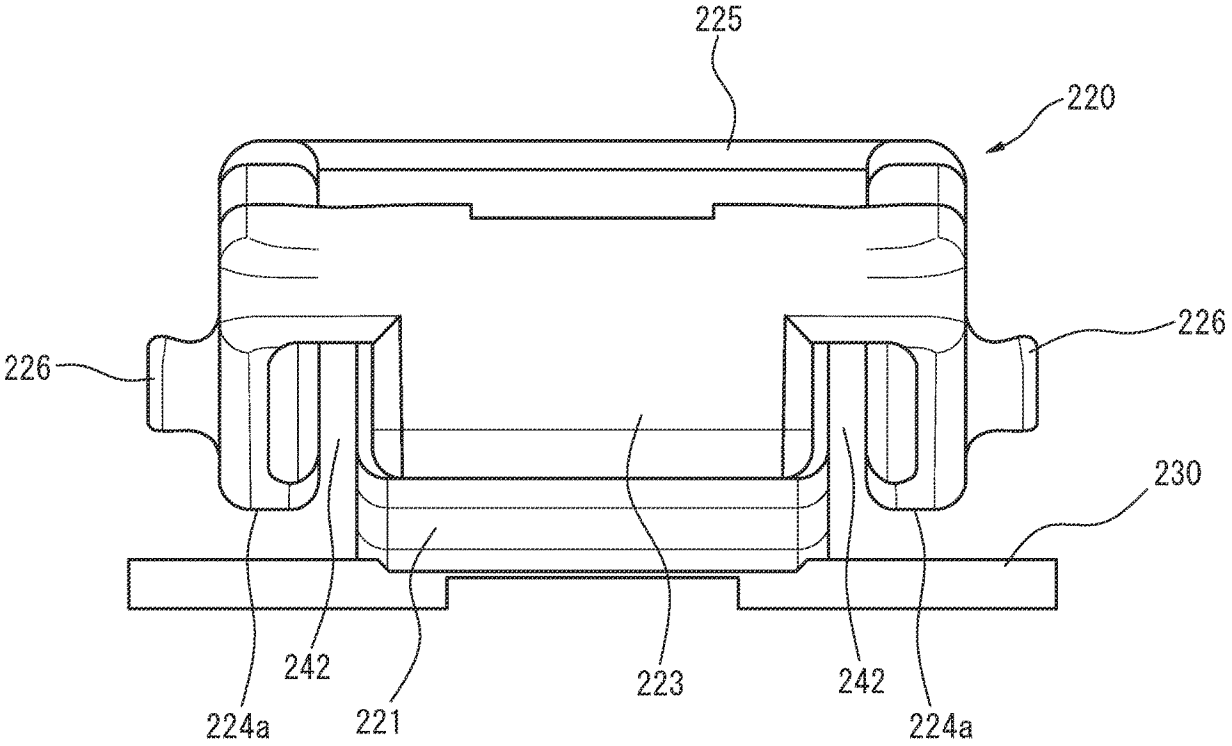
FIG. 6 is a side view when the lock arm shown in FIG. 5 is viewed in a B direction.

The hood portion 240 defines an annular gap 250, into which a tubular portion 911 of the connector housing 910 is fitted, around the terminal housing portion 230. The hood portion 240 covers the outer periphery of the tubular portion 911 of the connector housing 910 which is fitted into the gap 250. The hood portion 240 includes a horizontal guide groove 241 into which a horizontal guide rib 912 of the connector housing 910 is fitted while sliding, and vertical guide grooves 242 (refer to FIG. 6) to which vertical guide ribs 913 of the connector housing 910 are fitted while sliding.

When the connector housing 910 is attached to the connector housing 200, the horizontal guide groove 241 and the vertical guide grooves 242 are respectively fitted to the horizontal guide rib 912 and the vertical guide ribs 913.

The hood portion 240 includes a spacer insertion opening 243 on the side surface (inner side surface in FIG. 4) thereof. The spacer insertion opening 243 is an opening through which a spacer 400 is attached (inserted) to the connector housing 200, and is provided at a position corresponding to a spacer insertion portion (not shown) of the terminal housing portion 230. The spacer 400 is inserted in the arrow Y direction (a width direction of the connector housing 200) in FIG. 4 through the spacer insertion opening 243.

When the spacer 400 is inserted from the spacer insertion opening 243 into the connector housing 200, the spacer 400 includes an engagement arm 410 which is elastically deformed in the insertion process and locks the spacer 400 at a predetermined position. The spacer 400 includes lances 420 which lock the electric wire terminal housed in the terminal housing portion 230 of the connector housing 200 in the state where the spacer 400 is locked at the predetermined position. When the electric wire terminal is inserted into the terminal housing portion 230, after each of the lances 420 is temporarily elastic-deformed in the direction moving away from the electric wire terminal, the lance 420 is returned to the original shape.

In this way, the lances 420 of the spacer 400 are portions which are elastically deformed in the process in which the electric wire terminal is attached to the connector housing 200.

A packing 500 has a tubular shape which can be externally fitted into the terminal housing portion 230 of the connector housing 200. The packing 500 is formed of synthetic rubber or natural rubber having appropriate elasticity.

Figure 8:
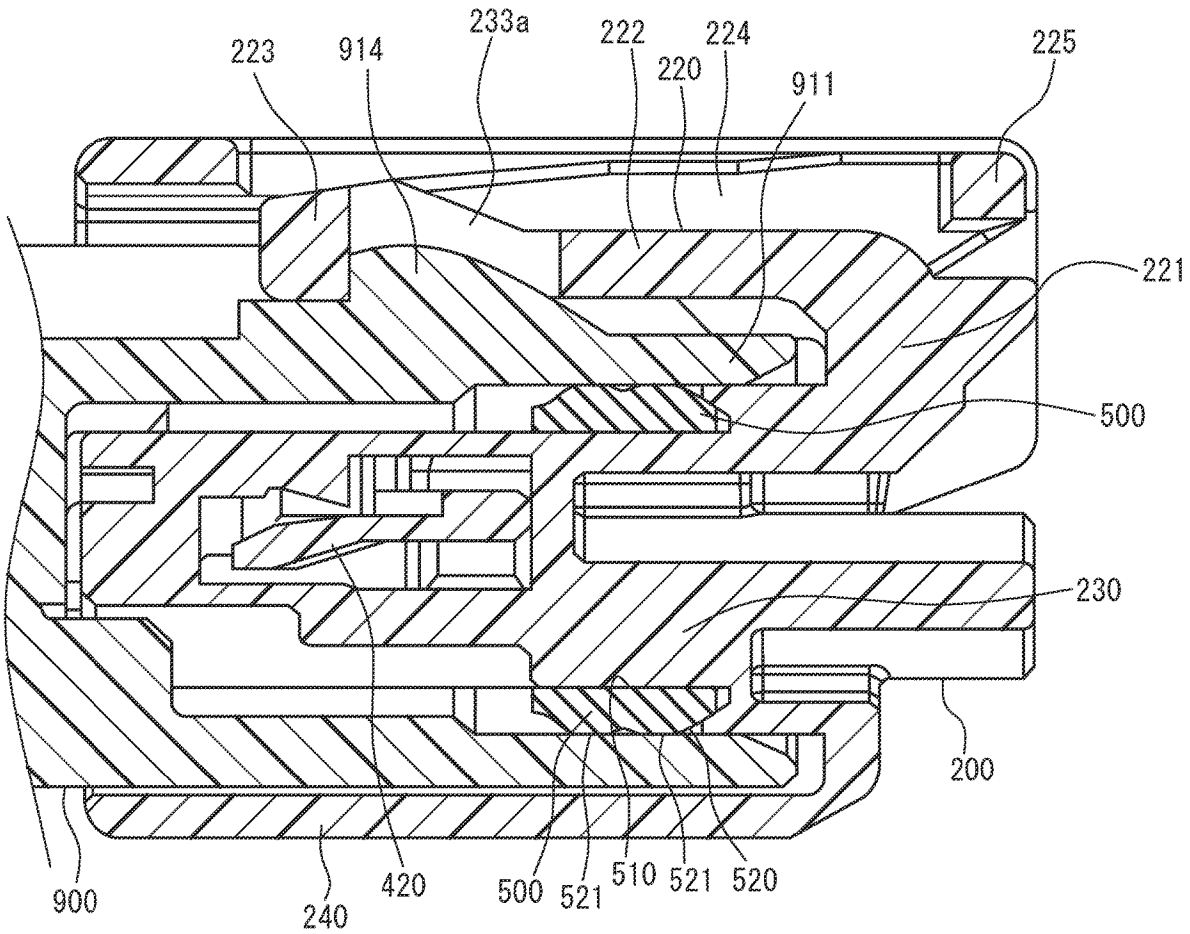
FIG. 8 is a longitudinal sectional view of the connector shown in FIG. 1 in a state where the connector is assembled as shown in FIG. 4.

As shown in FIG. 8, an inner peripheral surface 510 of the packing 500 is in close contact with the outer peripheral surface of the terminal housing portion 230. The packing 500 includes two annular projection pieces 521, which are in close contact with the inner peripheral surface of the tubular portion 911 of the connector housing 910, on an outer peripheral surface 520 of the packing 500. As shown in FIG. 8, in the packing 500, the inner peripheral surface 510 is in close contact with the outer peripheral surface of the terminal housing portion 230 and, the annular projection pieces 521 of the outer peripheral surface 520 are in close contact with the inner peripheral surface of the tubular portion 911. Accordingly, waterproof properties of the connector housing 200 are obtained.

As shown in FIG. 8, when a fitting length between the tubular portion 911 of the connector housing 910 and the terminal housing portion 230 reaches a predetermined value and the fitting between the connector housing 200 and the connector housing 910 is completed, the lock arm 220 engages with a lock protrusion 914 of the connector housing 910, and a fitting state between the connector housing 200 and the connector housing 910 is maintained.

When the tubular portion 911 of the connector housing 910 is fitted into the inner side of the hood portion 240, the lock arm 220 is formed integrally with the terminal housing portion 230 such that a free end side of the lock arm 220 can be elastically deformed so as to be bent in the direction orthogonal to the surface of the tubular portion 911 of the connector housing 910.

Specifically, as shown in FIGS. 4 to 8, the lock arm 220 is formed in a cantilever shape, and includes a base end portion 221 which is erected from the terminal housing portion 230, an approximately flat plate shaped leaf spring portion 222 which extends from the tip (upper end) of the base end portion 221 to the front end side (connector housing 910 side) of the connector housing 200 in the mutual fitting direction X of the connector housing, a protrusion engagement portion 223 which is provided on the tip of the leaf spring portion 222 which is a free end and engages with the lock protrusion 914 of the connector housing 910, a pair of connection arm portions 224 which extends from both sides of the protrusion engagement portion 223 to the rear end side of the connector housing 200, an operation portion 225 which is connected to the rear end portion of the pair of connection arm portions 224, and stoppers 226 which protrudes from the side surfaces of the connection arm portions 224. Gaps for allowing displacement of the connection arm portions 224 are secured below the connection arm portions 224.

The protrusion engagement portion 223 includes an engagement hole 223*a* which engages with the lock protrusion 914 of the connector housing 910.

While the connector housing 200 and the connector housing 910 are fitted into each other, the lock arm 220 is elastically deformed so as to be bent in the arrow Z1 direction (refer to FIG. 7) in which the leaf spring portion 222 is orthogonal to the plate thickness, and the lock protrusion 914 is inserted to under the protrusion engagement portion 223. When the fitting between the connector housing 200 and the connector housing 910 is completed, due to a restoring force of the leaf spring portion 222, the position of the protrusion engagement portion 223 is returned to the original position before the protrusion engagement portion 223 is elastically deformed. Accordingly, as shown in FIG. 8, the lock protrusion 914 of the connector housing 910 engages with the engagement hole 223*a*, and the connection between the connector housing 200 and the connector housing 910 is maintained.

Figure 7:
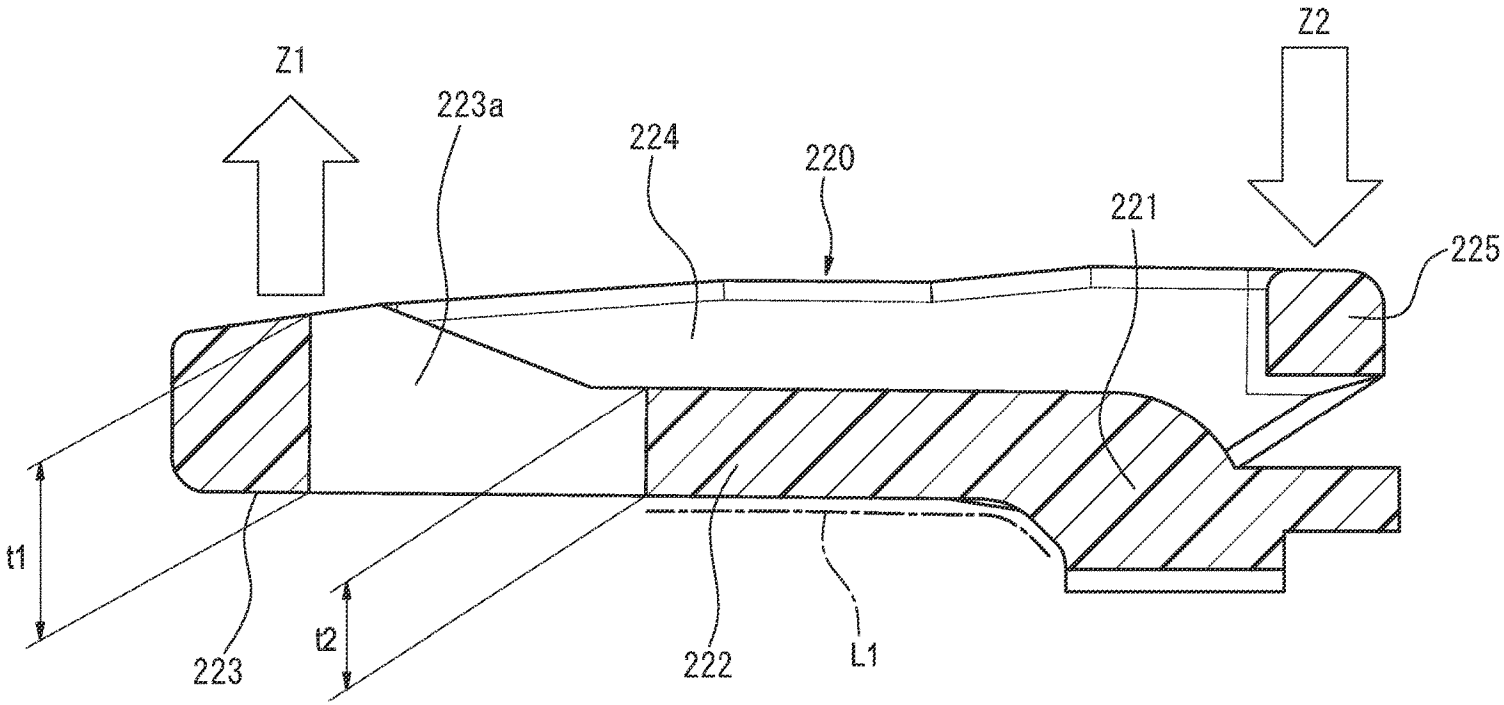
FIG. 7 is a sectional view of the lock arm shown in FIG. 5 taken along line A-A.

Meanwhile, as shown in FIG. 7, when the operation portion 225 is pressed in a Z2 direction, the connection arm portion 224 rotates around its bottom end portion 224*a* (which is contacted to the surface of the terminal housing portion 230), and thus the protrusion engagement portion 223 which is continuous to the front end of the connection arm portion 224 is lifted in the arrow Z1 direction (refer to FIG. 7). Accordingly, the engagement between the protrusion engagement portion 223 and the lock protrusion 914 is released, and the connector housing 200 and the connector housing 910 can be separated from each other.

The stoppers 226 on the connection arm portions 224 can abut on interference portions (not shown) of the connector housing 200. The stoppers 226 are portions which reduce the connection arm portions 224 from being excessively deformed and damaged in a case where a force in the direction opposite to the arrow Z2 direction is applied to the operation portion 225.

The base end portion 221 of the lock arm 220 which is erected from the terminal housing portion 230 is formed so as to have a smooth curve shape in which a bending load is not easily collected in the base end portion 221. Accordingly, while the connector housing 200 and the connector housing 910 are fitted into each other or when the operation portion is 225 pressed, in a case where the leaf spring portion 222 is elastically deformed so as to be bent, shear stress is not collected in the base end portion 221, and the shear stress is distributed over a wide range in the leaf spring portion 222. A region L1 of the leaf spring portion 222 shown by a dashed line in FIG. 7 shows an example of the region in which the shear stress is distributed when the leaf spring portion 222 is elastically deformed.

A thickness t1 of the protrusion engagement portion 223 of the lock arm 220 is thicker than a thickness t2 of the leaf spring portion 222. That is, the protrusion engagement portion 223 is formed so as to be thicker than the leaf spring portion 222.

In this way, the lock arm 220 of the connector housing 200 is the portion which is elastically deformed in the process in which the connector housing 910 of the mating connector 900 is attached to the connector housing 200.

As described above, the electric wire guide cover 300 is the member having portions (engagement pieces 315 and 325) which are elastically deformed in the process in which the electric wire guide cover 300 is attached to the connector housing 200. The spacer 400 is also the member having a portion (lance 420) which is elastically deformed in the process in which the electric wire terminal is attached to the connector housing 200.

In the present example, in this way, the members having portions, which are elastically deformed in the process in which other members are attached to the main body (connector housing 200) of the connector 100 and the connector 100 is manufactured, are formed of a hydrolysis-resistant material.

Specifically, the electric wire guide cover 300 and the spacer 400 are integrally formed by molding methods such as injection molding using a composite material of polybutylene terephthalate (PBT) and glass fibers. For example, such composite material includes the PBT-GF15 made from PBT as a base polymer and 15% by weight of glass fibers. The base polymer of this composite material. PBT, has been subjected to a treatment to enhance its hydrolysis-resistant performance. The treatment to enhance its hydrolysis-resistant performance includes a treatment to replace the hydroxyl group (—OH) of the carboxyl group (—COOH), which affects the hydrolysis of PBT, with other atom or other molecule serving to enhance hydrolysis-resistant performance. In addition, the hydrolysis-resistant material used for the connector 1 is not limited to this composite material, and other hydrolysis-resistant material may be used.

The connector housing 200 is the member having the portion (lock arm 220) which is elastically deformed when the connector housing 200 is attached to and detached from the connector housing 910 of the mating connector 900. Similarly to the above, the connector housing 200 may be also molded using PBT that has been subjected to a treatment to enhance its hydrolysis-resistant performance.

According to the above-described connector 100, even when the connector housing 200, the electric wire guide cover 300, and the spacer 400 formed of a hydrolysis-resistant material are used under a high-temperature and high-humidity environment such as an engine compartment over a long period, a decrease in mechanical strength due to hydrolysis of the constituent materials does not easily occur. Accordingly, even when the members are repeatedly detached while being used under the above-described environment over a long period, it is possible to reduce the members from being damaged.

In other words, since the connector housing 200, the electric wire guide cover 300, and the spacer 400 are formed of a hydrolysis-resistant material, it is possible to reduce the cantilevered engagement portions (the lock arm 220 of the connector housing 200, the lance 420 of the spacer 400, and the engagement pieces 315 and 325 of the electric wire guide cover 300), in which a decrease in mechanical strength is particularly a problem, from deteriorating. Particularly, even when the connector housing 200 and the electric wire guide cover 300, which are exposed to the outside air when the connector 100 is used, are subjected to conditions in which deterioration due to hydrolysis easily occurs, it is possible to reduce the deterioration. Deterioration of the spacer 400, which is hardly exposed to the outside air when the connector 100 is used, is also reduced, and reliability of the entire connector 100 can increase.

In addition, the invention is not limited to the above embodiment, but modifications, improvements, and so on may be made thereon suitably. In addition, materials, shapes, dimensions, numbers, arrangement places, etc. of respective constituent members in the above embodiment are not limited, but each constituent member may have any material, any shape, any dimensions, any number, any arrangement place, etc. as long as the invention can be carried out.

For example, the connector housing 200, the electric wire guide cover 300, and the spacer 400 may be formed using other materials having hydrolysis-resistant in addition to the PBT-GF 15.

Even when the component of the invention is the member (for example, the connector housing 910 of the mating connector 900) which does not have the above-described portion which is elastically deformed, the component may be formed using a hydrolysis-resistant material. However, in general, since the cost of the hydrolysis-resistant material is higher than the costs of typical resin materials, from the viewpoint of decreasing the manufacturing cost of the connector 100, preferably, the hydrolysis-resistant material is used in only the member having the portion which is elastically deformed.

In a case where the cover mounting portion 210 of the connector housing 200 and the connection wall 340 of the electric wire guide cover 300 are press-fitted to each other, the cover mounting portion 210 and the connection wall 340 may be elastically deformed. In this case, the cover mounting portion 210 and the connection wall 340 correspond to members having the portions which are elastically deformed. Accordingly, in this case, the connector housing 200 and the electric wire guide cover 300 may be formed of a hydrolysis-resistant material.

In view of the forgoing description, the connector housing 200 can be an exemplary first member. Further, each of the electric wire guide cover 300, the spacer 400, and the packing 500 can be a respective second member that can be attached to the exemplary first member (i.e., connector housing 200).

In addition, the characteristics of the above embodiment of the connector are described briefly as the following item (1) to (5).

(1) A connector (100) comprising:

a first member (200) constituting a main body of the connector; and a second member (300, 400, 500) attached to the first member, one or a plurality of specific members (300, 400) being selected from the group consisting of the first member (200) and the second members (300, 400, 500) to have a portion (315, 325, 420) to be elastically deformed upon the attachment, the specific member being formed of a hydrolysis-resistant material.

(2) The connector according to the item (1), wherein the specific member has a cantilevered engagement portion as the portion to be elastically deformed upon the attachment.

(3) The connector according to the item (1), wherein the specific member (300, 400) is the second member constituting a cover (300) to guide an electric wire extending from the first member constituting the main body (200) of the connector, the specific member is attached to the first member.

(4) The connector according to the item (3), wherein the specific member (400) is the second member constituting a spacer (400) attached inside of the first member constituting the main body (200) of the connector, and the spacer has a lance (420), as the portion to be elastically deformed upon the attachment, to engage with an electric terminal housed inside the main body.

(5) The connector according to the item (1), wherein the first member (100) has a lock arm (220) to be elastically deformed when being connected to a mating connector (900), and the first member is formed of the hydrolysis-resistant material.

REFERENCE SIGNS LIST

100: connector
200: connector housing
220: lock arm
300: electric wire guide cover
315: engagement piece of upper cover
325: engagement piece of lower cover
400: spacer
420: lance
900: mating connector

The invention claimed is:

1. A connector comprising:

a first member constituting a main body of the connector extending in a fitting direction; and a cover including an upper cover, a lower cover, and a hinge that connects an edge of the upper cover directly to an edge of the lower cover along the fitting direction, and one of the lower cover and the upper cover being rotatable about the hinge when a different one of the upper cover and the lower cover is attached to the first member, at least one of the first member and the cover having a portion to be elastically deformed upon the attachment of the different one of the upper cover and the lower cover to the first member, the at least one of the cover and the first member being formed of a hydrolysis-resistant material, the upper cover including one of an engagement piece and an engagement portion, the lower cover including a different one of the engagement piece and the engagement portion, and the engagement piece is the portion to be elastically deformed upon attachment.

2. The connector according to claim 1, wherein the at least one of the first member and the cover has a cantilevered engagement portion as the portion to be elastically deformed upon the attachment.

3. The connector according to claim 1, wherein the cover is formed of the hydrolysis material, and the cover is configured to guide an electric wire extending from the first member constituting the main body of the connector.

4. The connector according to claim 1, further comprising a spacer attached inside of the first member constituting the main body of the connector, and the spacer has a lance, as the portion to be elastically deformed upon the attachment, to engage with an electric terminal housed inside the main body, wherein at least one of the first member, the cover and the spacer being formed of the hydrolysis-resistant material.

5. The connector according to claim 1, wherein the first member has a lock arm to be elastically deformed when being connected to a mating connector, and the first member is formed of the hydrolysis-resistant material.

6. The connector according to claim 1, wherein the upper cover including the engagement piece and another engagement portion, the lower cover including the engagement portion and another engagement piece, the engagement portion of the lower cover engaging the engagement piece of the upper cover and the another engagement piece of the lower cover engaging the another engagement portion of the upper cover.

7. The connector according to claim 1, wherein the first member further including a recessed portion and a projection portion adjacent to the recessed portion, and the upper cover including an engagement recessed portion that receives the projection portion when the cover is connected to the first member.

8. The connector according to claim 1, wherein the first member further including a terminal housing portion, a hood portion, and a lock arm, a cover mounting portion adjacent to a first end of the first member, and an opening at a second end of the first member, the hood portion being spaced apart from the terminal housing portion by a gap, the lock arm being cantilevered to the terminal housing portion, and the lock arm being elastically deformable, the opening being in communication with the gap, and the cover covers the cover mounting portion when the cover is connected to the first member.

9. The connector according to claim 1, wherein the hydrolysis-resistant material is a composite material of polybutylene terephthalate and glass fibers.

* * * * *